United States Patent [19]

Mosser, III: Benjamin H.

[11] Patent Number: 4,548,459

[45] Date of Patent: Oct. 22, 1985

[54] ELECTRICAL TERMINAL FOR WIRES OF DIFFERENT GAUGES

[75] Inventor: Mosser, III: Benjamin H., Middletown, Pa.

[73] Assignee: AMP Incorporated, Harrisburg, Pa.

[21] Appl. No.: 646,653

[22] Filed: Aug. 31, 1984

[51] Int. Cl.[4] ..... H01R 9/08

[52] U.S. Cl. ..... 339/97 P; 339/259 R

[58] Field of Search ..... 339/97 R, 97 P, 98, 339/99 R, 259

[56] References Cited

U.S. PATENT DOCUMENTS

| | | | |
|---|---|---|---|
| 3,950,062 | 4/1976 | Reavis, Jr. | 339/97 R |
| 4,118,103 | 10/1978 | Leidy et al. | 339/98 |
| 4,310,212 | 1/1982 | Aujla et al. | 339/97 R |
| 4,491,382 | 1/1985 | Ishikawa | 339/259 R |

*Primary Examiner*—Joseph H. McGlynn

*Attorney, Agent, or Firm*—Robert W. J. Usher

[57] ABSTRACT

A one-piece electrical terminal for wires of different gauges comprising a plate portion including a pair of inner, resilient limbs arranged side-by-side in spaced apart relation with opposed edges defining between them a wire receiving slot and a pair of outer, resilient limbs arranged in respective opposite sides of and spaced from the pair of inner limbs. Insulated wire can be forced perpendicularly of its axis into a mouth of the wire receiving slot so that the edges of the inner limbs penetrate the insulation and establish permanent connection to the wire core with deformation of the inner limbs towards the outer limbs. Insertion of a small wire causes resilient deformation of only the inner limbs which remain spaced from the outer limbs whereas insertion of a large insulated wire deforms the inner limbs into engagement with the outer limbs producing resilient deformation thereof.

6 Claims, 7 Drawing Figures

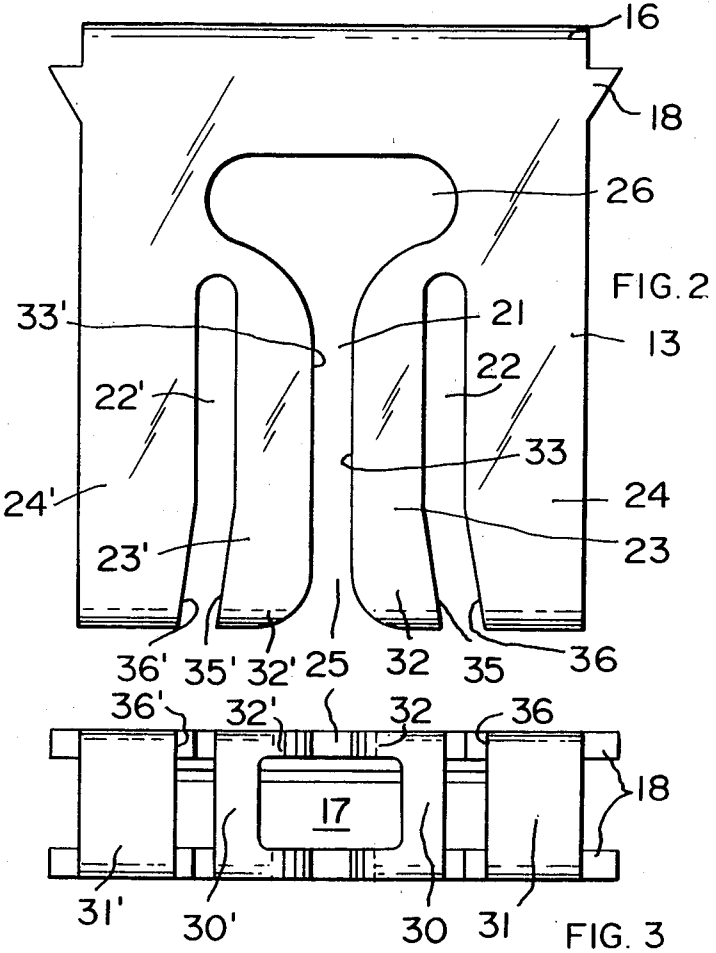
FIG. 2
16
18
26
13
24
23
36
33
21
22
35
32
25
32'
35'
36'
22'
23'
33'
24'
FIG. 3
18
36
31
30
32
17
32'
30'
36'
31'
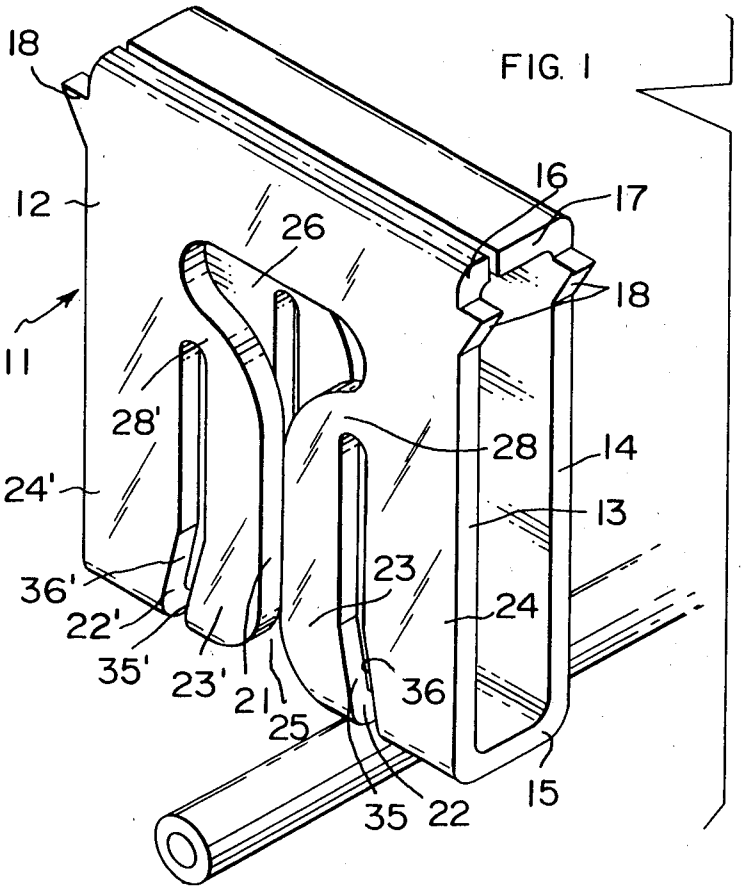
FIG. 1
17
18
16
14
13
15
28
24
36
22
23
35
26
25
21
23'
28'
35'
22'
36'
24'
12
11
18

ELECTRICAL TERMINAL FOR WIRES OF DIFFERENT GAUGES

The invention relates to an electrical terminal suitable for terminating wires of a wide range of gauges.

There is often a requirement to terminate wires of greatly differing size at the same location for use in an electrical appliance and, in the interests of economy in manufacture, application and in inventory, this should desirably be achieved using identical terminals. However, terminals of the type in which wire is forced into a slot in a metal plate such that the slot edges establish permanent connection to the wire core, have in general only been suitable for establishing connection only to wires of a single gauge or to a very small range of gauges.

It is an object of the invention to provide a terminal of the above-mentioned type which can establish permanent connection to wires over a wide range of gauges.

According to one aspect of the invention there is provided a one-piece electrical terminal for wires of different gauges which terminal is stamped and formed from sheet metal and comprises a plate portion including a pair of inner, resilient limbs arranged side-by-side in spaced apart relation with opposed edges defining between them a wire receiving slot and a pair of outer, resilient limbs arranged on respective opposite sides of and spaced from the pair of inner limbs, all the limbs being coplanar whereby insulated wire can be forced perpendicularly of its axis into a mouth of the wire receiving slot so that the edges of the inner limbs penetrate the insulation and establish permanent connection to the wire core with deformation of the inner limbs towards the outer limbs, insertion of a small wire causing resilient deformation of only the inner limbs which remain spaced from the outer limbs whereas insertion of a large insulated wire deforming the inner limbs outwardly so that their outer edges engage the outer limbs producing resilient deformation thereof.

A wire of very small gauge (such as a magnet wire) is terminated by resilient deformation only of the inner limbs while a wire of large gauge is terminated by the deformation of the inner limbs and the resilient deformation of the outer limbs.

In a preferred construction the terminal includes a further plate portion similar to the first plate portion and extending substantially parallel thereto joined to the first plate portion at the wire receiving end by a bight, the wires and outer limbs of respective plate portions being joined at the wire receiving end by strap portions of the bight.

According to another aspect of the invention, there is provided an electrical connection comprising a one-piece stamped and formed sheet metal terminal having a wire receiving slot and inner and an outer deformable limbs, the inner limb defining a wall of the slot, a wire received in the slot as a force fit, deforming the inner limb against the outer limb with resilient deformation thereof to grip the wire.

Identical terminals can thus be used for wires of greatly differing size facilitating termination by mass production techniques.

An example of the invention will now be described with reference to the accompanying drawings in which:

FIG. 1 is an isometric view of a terminal according to the invention;

FIG. 2 is a side elevation of the terminal;

FIG. 3 is a view of the terminal from a wire receiving end;

Figure 5:
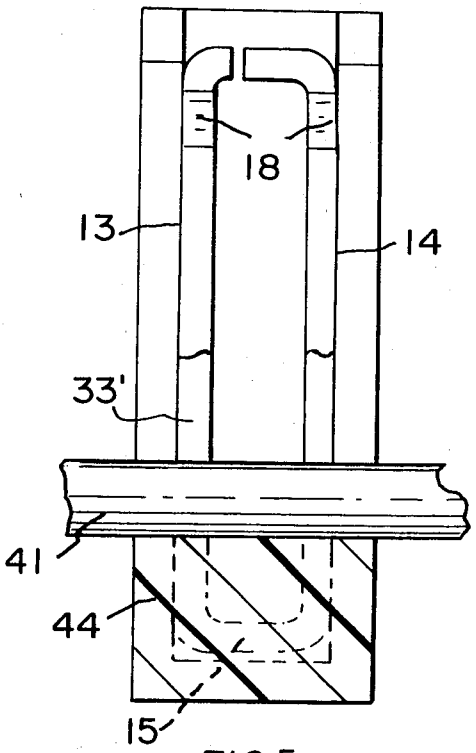
FIG. 5 is a cross-sectional view taken along line 5—5 of FIG. 4.

The terminal 11 is stamped and formed from a single piece of sheet metal stock and comprises a strip 12 which has been reversely bent to provide first and second plate portions 13 and 14 joined at a wire receiving end by a bight 15 and having in-bent portions 16, 17 at their opposite, anchoring ends to define a box section. Anchoring tangs 18 are provided on the edges of the plates 13 and 14 at the anchoring end.

The terminal is provided with a wire receiving slot 21 located centrally between two identical clearance slots 22, 22', each slot extending into each plate 13, 14 through the bight 15 and thereby defining a pair of inner resilient arms 23, 23' having opposed edges 33, 33' and a pair of outer resilient arms 24, 24' joined at a wire receiving end of the terminal by strap-like portions 30, 30' and 31, 31', respectively constituting the bight. The wire receiving slot has a flared wire receiving mouth 25 at the wire receiving end and opens out to an enlarged, stress relieving, aperture 26 between blind ends 27 of the clearance slots and the anchoring end such that root ends 28, 28' of the inner arms 23, 23' are of reduced width to provide desired, relatively soft, spring characteristics in those arms.

The clearance slots 22, 22' extend parallel to the wire receiving slot from their blind ends to locations 29, 29' adjacent the mouth where they diverge to define inner limb portions 32, 32' of increased size adjacent the mouth for strengthening purposes. The inner limbs have canted outer edges 35, 35' opposite correspondingly canted edges 36, 36' of the outer limbs.

Figure 4:
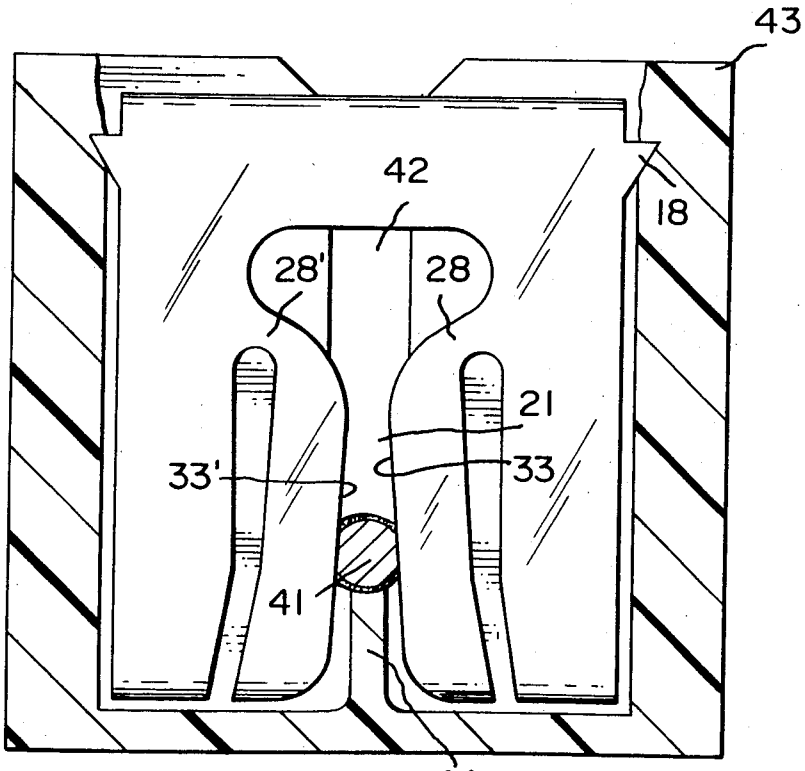
FIG. 4 is a side elevation of the terminal terminating a wire of small gauge in a housing.
Figure 7:
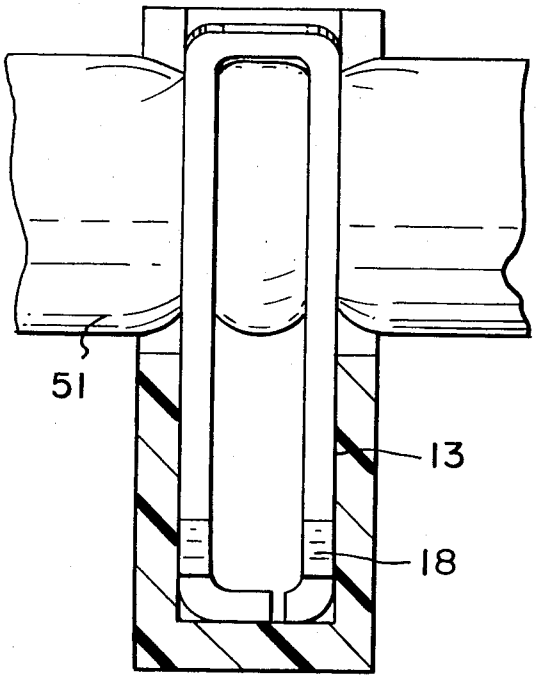
Figure 6:
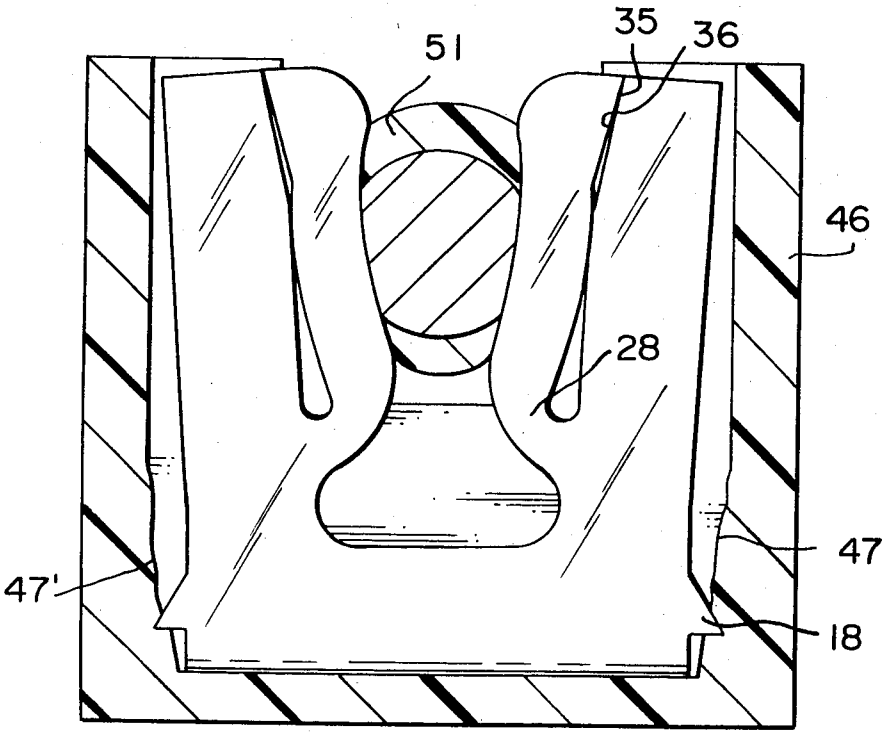
FIG. 6 is a side elevation of the terminal terminating a wire of large gauge in a housing; and, FIG. 7 is a cross-sectional view of the housing taken along line 7—7 of FIG. 6.

The terminal is capable of establishing a permanent connection with wires of a very wide range of gauges. As shown in FIGS. 4 and 5, a wire 41 of small gauge (for example 30, also known as magnet wire) having an insulation of varnish is preloaded into wire receiving slots 42, 42' in cavity walls of a housing 43 to extend across an anvil 44 which upstands from the base of the cavity (in a manner similar to that disclosed in U.S. Pat. No. 4,130,331). The terminal is then rammed into the cavity, wire receiving end leading, so that the wire is received as a force fit in slot 21 with penetration of the varnish insulation by the slot edges and resilient deflection of the inner arms 23, 23' outwardly towards arms 24, 24'.

To terminate a large gauge insulated wire 51 having a diameter exceeding the total width of the three slots 21, 22 and 22', the terminal is preloaded into a housing 46, anchoring end leading, which housing has convergent end walls 47, 47' to ensure anchoring engagement with the tangs 18. The wire is forced into the wire receiving slot 21 deforming the inner arms 23, 23' outwardly so that their edges 35, 35' and strap edges 30, 30' engage adjacent edges 36, 36' of outer arms 24, 24' with penetration of the insulation and resiliently deforms the outer arms 24, 24' to provide a gripping force on the wire.

Root ends 28, 28' undergo plastic deformation during the latter stages of insertion but intermediate portions of the inner arms retain a greater degree of resiliency. The main gripping force on the wire, however, is provided by the resilience of the outer arms 24, 24'.

Identical terminals can thus be used for terminating a large range of wires. When terminating wires of both a large and small gauge, the side walls of the housing assist in maintaining the structural shape of the terminal.

I claim:

1. A one-piece electrical terminal for wires of different gauges which terminal is stamped and formed from sheet metal and comprises a plate portion including a pair of inner resilient limbs arranged side-by-side in spaced apart relation with opposed edges defining between them a wire receiving slot and a pair of outer resilient limbs arranged on respective opposite sides of and spaced from the pair of inner limbs, all the limbs being coplanar whereby insulated wire can be forced perpendicularly of its axis into a mouth of the wire receiving slot so that the edges of the inner limbs penetrate the insulation and establish permanent connection to the wire core with deformation of the inner limbs towards the outer limbs, insertion of a small wire causing resilient deformation of only the inner limbs which remain spaced from the outer limbs whereas insertion of a large insulated wire deforming the inner limbs outwardly so that their outer edges engage the outer limbs producing resilient deformation thereof.

2. A terminal according to claim 1 in which the inner arms are plastically deformed at least at root ends remote from by insertion of a large insulated wire.

3. A terminal according to claim 1 or claim 2 including a further plate portion similar to the first plate portion and extending substantially parallel thereto being joined to the first plate portion at the wire receiving end by a bight, the inner and outer limbs of respective plate portions being joined at the wire receiving end by strap portions of the bight.

4. A terminal according to any one of the preceding claims in which opposed edges of the inner limbs diverge towards the mouth and remote edges of the inner limbs are canted outwardly towards the wire receiving end, opposed edges of the outer limbs being correspondingly canted.

5. An electrical connection comprising a one-piece stamped and formed sheet metal terminal having a wire receiving slot and inner and an outer deformable limbs, the inner limb defining a wall of the slot, a wire received in the slot as a force fit, deforming the inner limb against the outer limb with resilient deformation thereof to grip the wire.

6. An electrical connection comprising a one-piece stamped and formed sheet metal terminal having a wire receiving slot defined between a pair of inner limbs, a pair of resilient outer limbs on respective opposite sides of wire limbs, all the limbs being coplanar, a wire received in the slot as a force fit deforming the inner limbs against the outer limbs with resilient deformation thereof to grip the wire.

* * * * *